United States Patent [19]

Matsuzaki et al.

[11] Patent Number: 4,733,715

[45] Date of Patent: Mar. 29, 1988

[54] CEMENTED CARBIDE SLEEVE FOR CASTING APPARATUS

[75] Inventors: Masayuki Matsuzaki, Chiba; Tomihachi Kumehara, Kumagaya, both of Japan

[73] Assignee: Hitachi Carbide Tools, Ltd., Narita, Japan

[21] Appl. No.: 28,102

[22] Filed: Mar. 19, 1987

[30] Foreign Application Priority Data

Mar. 20, 1986 [JP] Japan ..... 61-40616[U]
Mar. 6, 1987 [JP] Japan ..... 62-52634

[51] Int. Cl.[4] ..... B22D 17/10; B22D 18/04

[52] U.S. Cl. ..... 164/306; 164/303; 164/312

[58] Field of Search ..... 164/303, 306, 309, 312, 164/316

[56] References Cited

FOREIGN PATENT DOCUMENTS 53-90112 8/1978 Japan ..... 164/303

*Primary Examiner*—Kuang Y. Lin
*Attorney, Agent, or Firm*—Finnegan, Henderson, Farabow, Garrett & Dunner

[57] ABSTRACT

A sleeve assembled in a casting apparatus through which a molten metal is fed into a die cavity, characterized in that at least part of said sleeve on which the molten metal impinges or flows fast under high pressure is made of cemented carbide consisting essentially of a hardening phase of WC, part of which may be substituted by TaC, NbC, TiC, etc., and 10–20 weight % based on the cemented carbide of a binder phase comprising Co, Ni, Cr, and optionally Mo, a weight ratio of Cr+Mo to the binder phase being 0.1–0.2 and a weight ratio of Mo to Cr being up to 3. This sleeve, when assembled in a die-casting apparatus or a low-pressure casting apparatus, enjoys an extremely long life because of its high resistance to oxidation and washing.

6 Claims, 4 Drawing Figures

CEMENTED CARBIDE SLEEVE FOR CASTING APPARATUS

BACKGROUND OF THE INVENTION

The present invention relates to a sleeve made of cemented carbide for casting apparatuses, and more particularly to a sleeve made of cemented carbide assembled in a low-pressure casting or die-casting apparatus at such a position that a molten metal to be cast impinges on or flows at high pressure.

The casting of low-melting point metals such as aluminum, magnesium, copper, zinc and their alloys is usually carried out by various methods using casting dies. A typical casting method is die casting by which a molten metal is supplied into a die cavity under high pressure exerted by a plunger. Another example of the casting methods is a low-pressure casting by which a molten metal is supplied into a die cavity under relatively low pressure exerted by a compressed air. In a die apparatus used for these methods, the molten metal impinges on a particular part of the apparatus or flows fast at high pressure therethrough. Such a particular part is usually called a sleeve for supplying a molten metal.

Particularly with respect to die casting apparatuses, there are two types, a hot chamber type in which a furnace for keeping the temperature of a melt high is assembled in a die machine, and a cold chamber type in which the furnace is provided separately from the die machine. The hot chamber type is suitable for low-melting point alloys of zinc, etc., and the cold chamber type is suitable for high-melting point alloys of aluminum, etc.

For instance, since an aluminum alloy is cast by a hot chamber-type die machine, an aluminum alloy melt is poured into a sleeve through its opening and then forced into a cavity under high pressure by a plunger sliding in the sleeve. A die for defining the cavity consists of two parts; one is stationally and the other is movable. After cooling the cast metal, the die is opened to remove the cast product. This die casting can easily provide castings with extremely high precision without requiring so much skills, so that it may be said to be a highly productive casting method.

The sleeve and the plunger are conventionally made of steel, such as die steel, for instance, hot die steel, SKD61 and the like.

On the other hand, used in the low-pressure casting is a die machine comprising a sleeve provided between a vertical melt supplying pipe and a die cavity. The molten metal is elevated through the vertical melt supply pipe by pressure exerted by a compressed air, and impinges on the sleeve and flows fast therethough because the inner diameter of the sleeve at its center is somewhat smaller than that of the other part of the sleeve in order to increase a melt pressure. This low-pressure casting can provide castings with substantially no pores, and since the molten metal remained in the supply pipe is recycled to the underlying furnace for reuse, its yield is very high. Likewise, the sleeve for the low-pressure casting apparatus is conventionally made of steel such as die steel, for instance, hot die steel, SKD61, and the like.

In both of them, however, a molten metal such as an aluminum melt at about 700° C. or higher is poured into the sleeve through its opening or flows fast therethrough under high preasure, so that the sleeve is vulnerable to erosion by oxidation and washing with the molten metal, particularly at such positions that the molten metal impinges upon or flows faster. In particular, in a die-casting apparatus comprising a lateral sleeve, the molten metal is poured into the sleeve through an opening thereof, so that an inner wall portion of the sleeve upon which the molten metal impinges directly is highly vulnerable to erosion by oxidation and washing. The term "washing" used herein means that the inner wall of the sleeve is subjected to strong actions of a molten metal, mechanically or chemically, which may lead to severe erosion of the inner wall. One of such actions is the adhesion of a molten metal, because the removal thereof by a molten metal supplied subsequently or a plunger moving within the sleeve back and forth is likely to cause surface layer of the sleeve to come off together with the adhered metal.

After the inner wall of the sleeve is eroded, the molten metal is likely to enter into the gap or clearance between the sleeve and the plunger, causing abrasion of the inner wall of the sleeve. In addition, the intrusion of the molten metal into the gap may cause the plunger to move eccentrically, resulting in a partially enlarged clearance between the sleeve and the plunger which allows the molten metal to spew.

Attempts have been made to prevent the above phenomenon. One of them is to rotate the sleeve before the erosion takes place, so that the molten metal impinges upon a different portion of the sleeve. Another proposal is that the sleeve be divided into two or more segments so that only a segment upon which the molten metal impinges is replaced (Japanese Patent Laid-Open No. 53-70034). This proposal, however, is not successful because it is extremely difficult to form a sleeve with divided segments while ensuring smooth movement of a plunger.

Japanese Patent Laid-Open No. 52-44726 discloses a die-casting machine comprising an injection sleeve made of ceramics or cermets. The listed ceramics include $Al_2O_3$, $3Al_2O_3 \cdot 2SiO_2$, $ZrO_2$, $Si_3N_4$, etc., and the listed cermets include TiC+Mo+Ni, TiN+Co, WC+Co, $ZrB_2$+Mo+Ni+Fe, $ZrB_2$+Ti, etc. However, such ceramics do not have sufficient mechanical strength and shock resistance, and such cermets do not have sufficient resistance to oxidation and washing.

U.S. Pat. No. 3,664,411 also discloses a die-casting apparatus comprising a shot duct in which a piston moves back and forth, the shot duct being lined with a ceramic material selected to withstand contact with the metal to be cast in respect of erosion phenomena and thermal fatigue. Listed examples of such ceramic material are silicon nitride, silicon carbide and zirconia. Again, these ceramic materials are not satisfactory in terms of mechanical strength and shock resistance.

The same is true of a sleeve for the low-pressure die-casting apparatus. That is, since the sleeve has a diameter-reduced portion or a neck portion to increase the pressure of a molten metal, it is washed with the molten metal at a higher speed and pressure. Thus, it is similarly subjected to oxidation and washing with the molten metal such as aluminum. The use of the eroded sleeve would cause uneven flow of the molten metal which in turn causes pinholes, cracks, blemishes, disfigurements, etc. on the cast products.

OBJECT AND SUMMARY OF THE INVENTION

An object of the present invention is, therefore, to provide a sleeve for casting apparatuses, which is highly resistant to oxidation and washing with a molten metal to be cast, thus avoiding frequent replacement thereof which would lead to lower productivity of casting.

As a result of intense research in view of the above object, it has been found that the use of cemented carbide for at least a portion of a sleeve upon which a molten metal impinges or flows fast under high pressure can greatly eliminate the above problems of oxidation and washing.

That is, the sleeve assembled in a casting apparatus through which a molten metal is fed into a die cavity according to the present invention is characterized in that at least part of the sleeve on which the molten metal impinges or flows fast under high pressure is made of cemented carbide consisting essentially of a hardening phase of tungsten carbide, part of which may be substituted by one or more carbides of elements selected from the Groups IV, V and VI of the Periodic Table, and 10–20 weight % based on the cemented carbide of a binder phase comprising cobalt, nickel, chromium and optionally molybdenum, a ratio by weight of chromium plus molybdenum to the binder phase being 0.1–0.2, and a ratio by weight of molybdenum to chromium being up to 0.3.

DETAILED DESCRIPTION OF THE INVENTION

Figure 1:
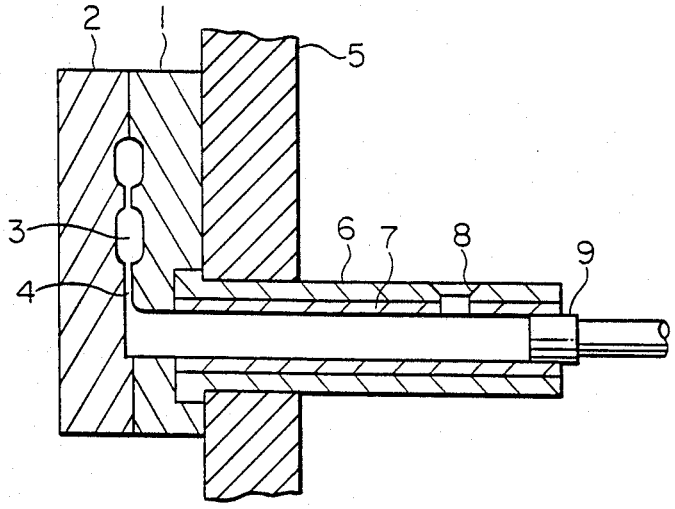
FIG. 1 is a cross-sectional view of a die-casting apparatus equipped with a lateral sleeve according to one embodiment of the present invention.

FIG. 1 shows a die-casting apparatus comprising a stationary die 1 and a movable die 2 both provided with corresponding recesses which form a cavity 3 and a gate 4 when tightly closed, an apparatus frame 5, a cylinder 6 for holding a sleeve 7, an opening 8 penetrating the cylinder 6 and the sleeve 7 and a plunger 9 movable in the sleeve 7 back and forth. At least part of the sleeve 7 is made of the cemented carbide according to the present invention. In this embodiment, a portion of the sleeve 7 just underneath the opening 8 is most likely to be subjected to oxidation and washing with a molten metal because the molten metal directly impinges thereupon. Thus, such portion should be made of the cemented carbide. When the sleeve 7 is relatively short, however, it may be formed integrally with the cemented carbide to facilitate its production.

Figure 2:
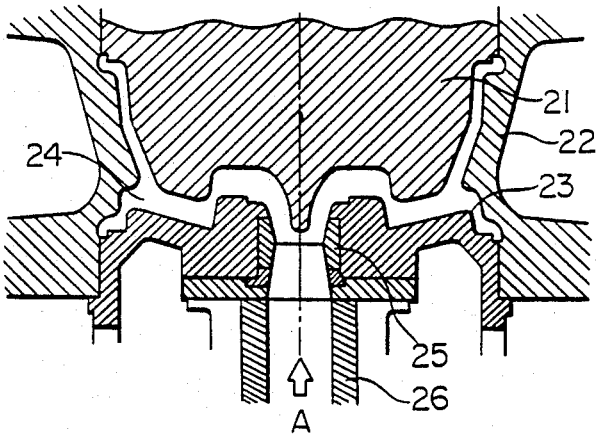
FIG. 2 is a cross-sectional view of a low-pressure casting apparatus equipped with a vertical sleeve according to another embodiment of the present invention.

FIG. 2 shows a low-pressure casting apparatus comprising dies 21, 22, 23 closed tightly for defining a cavity 24, a vertical, short sleeve 25 communicating with the cavity 24, and a melt supply pipe 26 communicating with the sleeve 25 and an underlying melt reservoir (not shown). Since the sleeve 25 has a diameter-reduced portion or a neck portion at a longitudinally center position thereof to increase the pressure of the molten metal to be fed into the cavity 24, that neck portion is subjected to the fast flow or impingement of the molten metal. Thus, the sleeve 25 is eroded by oxidation and washing with the molten metal particularly at the neck portion thereof.

The cemented carbide for forming the sleeve according to the present invention consists essentially of a hardening phase of WC which may be partly substituted, and 10–20 weight % based on the cemented carbide of a binder phase comprising Co, Ni, Cr and optionally Mo, a ratio by weight of Co+Mo to the binder phase being 0.1–0.2, and a ratio by weight of Mo to Cr being up to 3.

With respect to the hardening phase, WC is a main component, and up to 10 weight % of WC based on the cemented carbide may be substituted by one or more other carbides of elements selected from Groups IV, V and VI of the Periodic Table. Preferable carbides for substitution are TaC, NbC and TiC. The particle size of WC and other carbide particles is 2.5–10 μm, preferably 3–6 μm.

With respect to the binder phase, it should be 10–20 weight %. When it is less than 10 weight %, sufficient mechanical strength and toughness cannot be obtained, and when it exceeds 20 weight %, the cemented carbide is insufficient in hardness and is less resistant to oxidation and other chemical reactions.

Co may be a main component of the binder phase. Co is preferably 5–12 weight % based on the cemented carbide. When it is less than 5 weight %, sufficient strength cannot be obtained, and when it exceeds 12 weight %, the cemented carbide becomes somewhat softer.

Ni serves to increase the oxidation resistance of the cemented carbide, and also by forming a solid solution with Co, it helps increase the mechanical strength of the cemented carbide. The preferred amount of Ni is 4–9 weight % based on the cemented carbide.

Cr serves to increase oxidation resistance and corrosion resistance which make the sleeve highly resistant to erosion. When Mo is not contained, Cr should be 0.1–0.2 by weight per the binder phase. When it is less than 0.1, the alloying of Cr in the binder phase fails to provide sufficient effects of increasing heat resistance, oxidation resistance and corrosion resistance. On the other hand, when it exceeds 0.2, the mechanical strength of the cemented carbide is lowered.

Mo may be added to the cemented carbide to increase resistance to plastic deformation thereof and further to increase oxidation resistance. However, when it is contained too much, it tends to form $Mo_2C$ on grain boundaries, decreasing the mechanical strength of the cemented carbide. Thus, the weight ratio of Mo to Cr should be up to 3, if any.

As described above, since the sleeve of the present invention is made of the cemented carbide of the above composition at least at a desired portion, the sleeve can withstand the impingement or fast flow of a molten metal for an extended period of time without suffering from erosion.

The sleeve or part of the sleeve may be produced by the following procedures.

First, component powders are mixed together with an organic binder such as paraffin wax, and granulated to a desired particle size. The mixture is then formed into a green body of the desired shape by pressing. After working, the green body is sintered in vaccum at 1300°–1400° C. for 0.5–2 hours. The resulting sintered product is finally ground with a diamond grinder to have a smooth inner surface. If only part of the sleeve is formed with the cemented carbide, the whole sleeve is constituted by combining it with the other part of the sleeve which may be formed with die steel.

The present invention will be explained in further detail by the following Examples without intention of restricting the scope of the present invention which is defined by the claims attached hereto.

EXAMPLE 1

In the lateral, cold chamber-type die casting apparatus as shown in FIG. 1, part of the sleeve was formed with cemented carbides of various compositions shown in Table 1 below. Incidentally, the carbides contained in the cemented carbides had an average particle size of 4–5 μm. Also, all the cemented carbide samples were sintered at 1360° C. for 1 hour. That part was assembled in a portion on which a molten metal was supposed to impinge. As a molten metal, an aluminum alloy at about 700° C. was used and fed into a die cavity by means of a plunger under pressure of 200 kg/cm$^2$.

Test was conducted on each sleeve with respect to a life span which means a usable period without suffering from erosion, bending strength and hardness. The results are shown in Table 1. For the purpose of comparison, a sleeve sample made of die steel (No. 18) was also tested, and the results are shown in Table 1.

TABLE 1

| | Composition (wt. %) | | | | | | | | | Mechanical Properties | |
|---|---|---|---|---|---|---|---|---|---|---|---|
| No.(1) | WC | TaC | NbC | TiC | Co | Ni | Cr | Mo | Life (Days) | Bending Strength (kg/cm) | Hardness (Hv) |
| 1 | 85 | — | — | — | 7 | 6 | 2 | — | 45 | 300 | 900 |
| 2 | 85 | — | — | — | 6 | 6 | 3 | — | 50 | 250 | 920 |
| 3 | 82 | — | — | — | 10 | 6 | 2 | — | 40 | 310 | 890 |
| 4 | 89 | — | — | — | 5 | 4 | 2 | — | 47 | 230 | 980 |
| 5 | 77 | 5 | — | — | 10 | 6 | 2 | — | 40 | 300 | 890 |
| 6 | 80 | — | 2 | — | 10 | 6 | 2 | — | 40 | 300 | 890 |
| 7 | 79 | — | 1 | 2 | 10 | 6 | 2 | — | 42 | 250 | 900 |
| 8 | 82 | — | — | — | 10 | 6 | 1.5 | 0.5 | 43 | 310 | 890 |
| 9 | 80.5 | — | — | — | 8 | 8 | 2 | 1.5 | 45 | 280 | 910 |
| 10 | 81 | — | — | — | 8 | 8 | 2 | 1 | 45 | 300 | 900 |
| 11 | 81.5 | — | — | — | 8 | 8 | 1.5 | 1 | 45 | 290 | 900 |
| 12 | 82 | — | — | — | 10 | 6 | 0.5 | 1.5 | 40 | 330 | 880 |
| 13 | 85 | — | — | — | 15 | — | — | — | 20 | 320 | 950 |
| 14 | 84 | — | — | — | 8 | 8 | — | — | 30 | 310 | 900 |
| 15 | 83 | — | — | — | — | 17 | — | — | 25 | 300 | 850 |
| 16 | 85 | — | — | — | 6 | 5 | 4 | — | 15(2) | 200 | 950 |
| 17 | 75 | 5 | 2 | — | 8 | 7.5 | 0.5 | 2 | 30 | 270 | 900 |
| 18 | SKD 61 (JIS G 4404) | | | | | | | | 10 | — | 830 |

Note:
(1)Nos. 1–12: within the present invention
Nos. 13–17: Outside the present invention
No. 18: Conventional die steel
(2)Cracks appeared.

As is clear from Table 1, the sleeve samples (Nos. 1–12) made of the cemented carbides according to the present invention enjoyed much longer life than those outside the present invention (Nos. 13–17) and the conventional die steel sample (No. 18). This means that much higher productivity of die casting is provided by using the sleeve of the present invention, because less frequent replacement of the sleeve is needed.

EXAMPLE 2

Figure 3:
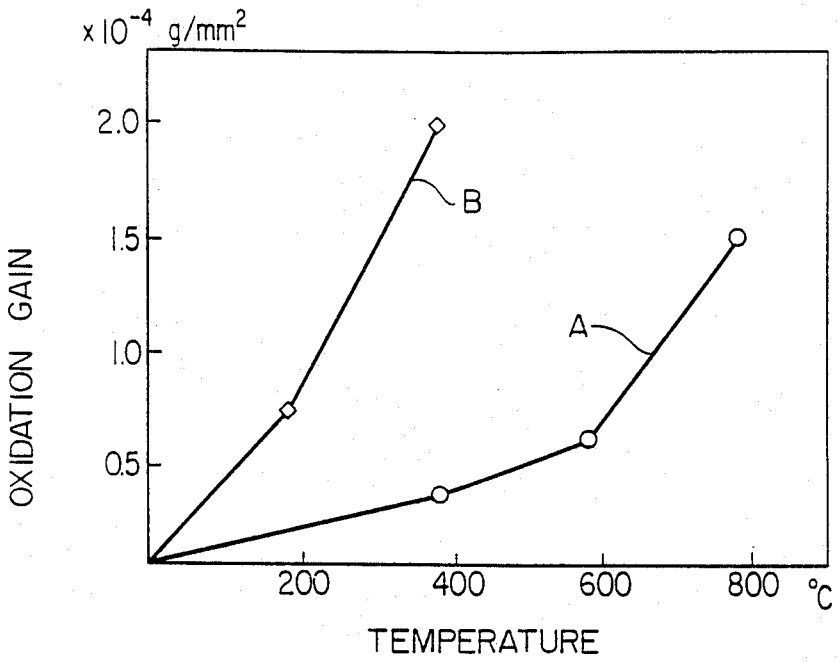
FIG. 3 is a graph showing the relations between oxidation gain and temperature.
Figure 4:
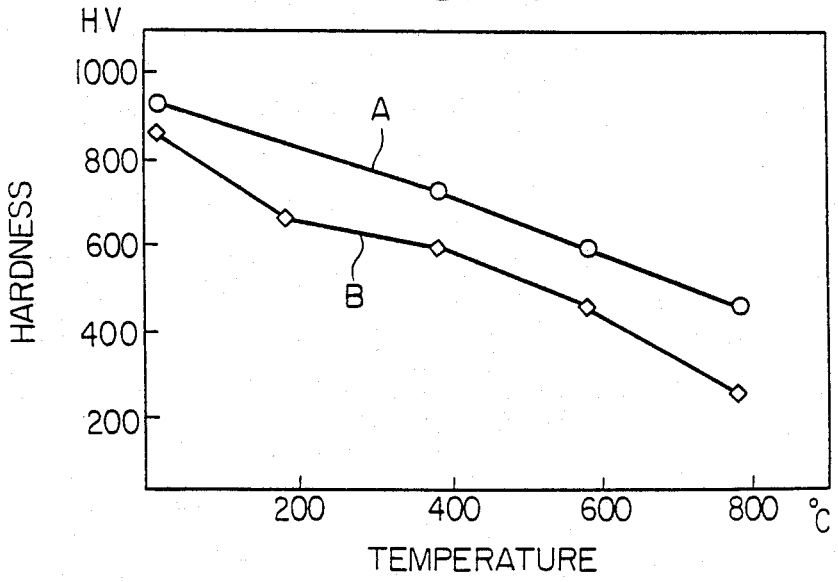
FIG. 4 is a graph showing the relations between hardness and temperature.

Comparison was made between the sleeve of the present invention (No. 1) and that of die steel (No. 18) with respect to oxidation gain and hardness at elevated temperatures. The results are shown in FIGS. 3 and 4, respectively. In both figures, A denotes the sleeve of the present invention, and B that of die steel. The oxidation gain means the weight increase of a sleeve sample by oxidation caused by use in the atmosphere at elevated temperatures. FIG. 3 indicates that the sleeve of the present invention (A) is much more resistant to oxidation than that of die steel (B) at elevated temperatures, and FIG. 4 indicates that the sleeve of the present invention (A) is harder than that of die steel (B) at elevated temperatures. Particularly, since the sleeve of the present invention (A) is about 1.5 times as hard as that of die steel (B) at 700°–800° C. which corresponds to the temperature of molten aluminum to be cast, it can be said that the sleeve of the present invention has excellent wear resistance at high temperatures.

EXAMPLE 3

In the low-pressure casting apparatus as shown in FIG. 2, the sleeve was formed with cemented carbides of various compositions shown in Table 2 below. Incidentally, the WC particles had an average particle size of 4–5 μm. Also, all the cemented carbide sleeves were sintered at 1360° C. for 1 hour. As a molten metal, an aluminum alloy at about 700° C. was used and fed into a die cavity under pressure of 1.5 kg/cm$^2$ in the direction of arrow A. The same tests as in Table 1 were conducted on each of the sleeve samples with respect to life span. The results are shown in Table 2.

TABLE 2

| | Composition (wt. %) | | | | | | | | |
|---|---|---|---|---|---|---|---|---|---|
| No.(1) | WC | TaC | NbC | TiC | Co | Ni | Cr | Mo | Life (Days) |
| 1 | 85 | — | — | — | 7 | 6 | 2 | — | 75 |
| 2 | 85 | — | — | — | 6 | 6 | 3 | — | 80 |
| 3 | 82 | — | — | — | 10 | 6 | 2 | — | 70 |
| 4 | 89 | — | — | — | 5 | 4 | 2 | — | 78 |
| 5 | 77 | 5 | — | — | 10 | 6 | 2 | — | 65 |
| 6 | 80 | — | 2 | — | 10 | 6 | 2 | — | 65 |
| 7 | 79 | — | 1 | 2 | 10 | 6 | 2 | — | 70 |
| 8 | 82 | — | — | — | 10 | 6 | 1.5 | 0.5 | 68 |
| 9 | 80.5 | — | — | — | 8 | 8 | 2 | 1.5 | 75 |
| 10 | 81 | — | — | — | 8 | 8 | 2 | 1 | 75 |
| 11 | 81.5 | — | — | — | 8 | 8 | 1.5 | 1 | 73 |
| 12 | 82 | — | — | — | 10 | 6 | 0.5 | 1.5 | 65 |
| 13 | 85 | — | — | — | 15 | — | — | — | 30 |
| 14 | 84 | — | — | — | 8 | 8 | — | — | 50 |
| 15 | 83 | — | — | — | — | 17 | — | — | 40 |
| 16 | 85 | — | — | — | 6 | 5 | 4 | — | 25(2) |

TABLE 2-continued

| No.[1] | WC | TaC | NbC | TiC | Co | Ni | Cr | Mo | Life (Days) |
|---|---|---|---|---|---|---|---|---|---|
| | Composition (wt. %) | | | | | | | | |
| 17 | 75 | 5 | 2 | — | 8 | 7.5 | 0.5 | 2 | 55 |
| 18 | SKD 61 (JIS G 4404) | | | | | | | | 2 |

Note:
[1]Nos. 1-12: within the present invention
Nos. 13-17: Outside the present invention
No. 18: Conventional die steel
[2]Cracks appeared.

As is clear from Table 2, the sleeves of the present invention (Nos. 1-12) have much longer life than those outside the present invention (Nos. 13-17) and the conventional die steel sleeve (No. 18).

As described above, since the sleeve assembled in a casting apparatus either for die casting or for low-pressure casting according to the present invention is at least partly made of the cemented carbide as defined above, it can enjoy extremely long life without suffering from erosion which may be caused by oxidation and washing with a molten metal to be cast. Therefore, the casting apparatus equipped with the sleeve of the present invention can be operated at high productivity because less frequent replacement of the sleeve is needed.

What is claimed is:

1. A sleeve assembled in a casting apparatus through which a molten metal is fed into a die cavity, wherein at least that part of said sleeve on which said molten metal impinges or flows fast under high pressure is made of cemented carbide consisting essentially of a hardening phase of tungsten carbide or tungsten carbide with at least part thereof being substituted by at least one carbide of an element selected from the Groups IV, V and VI of the Periodic Table, and 10-20 weight % based on said cemented carbide of a binder phase comprising cobalt, nickel, and chromium, a ratio by weight of chromium to said binder phase being 0.1-0.2.

2. The sleeve assembled in a casting apparatus according to claim 1, wherein said cemented carbide consists essentially of tungsten carbide or tungsten carbide with up to 10 weight % based on said cemented carbide of said tungsten carbide being substituted by at least one carbide of an element selected from the Groups IV, V and VI of the Periodic Table, and 10-20 weight % based on said cemented carbide of a binder phase comprising 5-12 weight % of cobalt and 4-9 weight % of nickel, and further chromium, a ratio by weight of chromium to said binder phase being 0.1-0.2.

3. The sleeve assembled in a casting apparatus according to claim 1, wherein said casting apparatus is a die-casting apparatus.

4. The sleeve assembled in a casting apparatus, according to claim 1, wherein said casting apparatus is a low-pressure casting apparatus.

5. The sleeve assembled in a casting apparatus according to claim 1, wherein said binder phase also includes molybdenum and wherein the ratio by weight of chromium plus molybdenum to said binder phase is 0.1-0.2, and the ratio by weight of molybdenum to chromium being up to 3.

6. The sleeve assembled in a casting apparatus according to claim 2, wherein said binder phase also includes molybdenum and wherein the ratio by weight of chromium plus molybdenum to said binder phase is 0.1-0.2, and the ratio by weight of molybdenum to chromium being up to 3.

* * * * *